US011148183B2

(12) United States Patent
Sato et al.

(10) Patent No.: US 11,148,183 B2
(45) Date of Patent: Oct. 19, 2021

(54) METHOD OF PRODUCING SHAPED ARTICLE, TOOLING, AND TUBULAR SHAPED ARTICLE

(71) Applicant: NIPPON STEEL & SUMITOMO METAL CORPORATION, Tokyo (JP)

(72) Inventors: Masahiko Sato, Tokyo (JP); Tohru Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 326 days.

(21) Appl. No.: 15/512,485

(22) PCT Filed: Sep. 17, 2015

(86) PCT No.: PCT/JP2015/076535
§ 371 (c)(1),
(2) Date: Mar. 17, 2017

(87) PCT Pub. No.: WO2016/043280
PCT Pub. Date: Mar. 24, 2016

(65) Prior Publication Data

US 2017/0274434 A1 Sep. 28, 2017

(30) Foreign Application Priority Data

Sep. 18, 2014 (JP) ..... JP2014-190189

(51) Int. Cl.
*B21C 37/06* (2006.01)
*B21D 5/01* (2006.01)
(Continued)

(52) U.S. Cl.
CPC ..... *B21C 37/065* (2013.01); *B21C 37/0803* (2013.01); *B21C 37/0815* (2013.01);
(Continued)

(58) Field of Classification Search
CPC ..... B21C 37/065; B21C 37/0803; B21C 37/0815; B21C 37/15; B21C 37/155;
(Continued)

(56) References Cited

U.S. PATENT DOCUMENTS 1,972,294 A * 9/1934 Fantz ..... B21C 37/28 285/179
2,004,491 A * 6/1935 Lucning ..... B21C 37/286 285/183
(Continued)

FOREIGN PATENT DOCUMENTS

DE 2341857 B1 * 2/1975 ..... B21D 5/01
DE 102009017571 A1 11/2010
(Continued)

OTHER PUBLICATIONS

Altan and Tekkaya. Sheet Metal Forming—Processes and Applications—9.5 Mechanics of Tube Hydroforming. ASM International. 2012. Retrieved from <https://app.knovel.com/hotlink/pdf/id:kt00AD2BS1/sheet-metal-forming-processes-2/mechanics-tube-hydroforming>. (Year: 2012).*
(Continued)

*Primary Examiner* — Adam J Eiseman
*Assistant Examiner* — P Derek Pressley
(74) *Attorney, Agent, or Firm* — Birch, Stewart, Kolasch & Birch, LLP

(57) ABSTRACT

A method of production of a shaped article able to suppress occurrence of shaping defects, that is, a method of production of a shaped article including a first step of press-forming a metal plate (1*a*) into a U-shape to obtain a U-shaped article (1*b*) having a bottom part (2) straight extending in a longitudinal direction and a second step of press-forming the U-shaped article (1*b*) to bend it in the longitudinal direction
(Continued)

so that the bottom part (2) of the part projects to the inside and obtain a U-cross-section bent article (1*c*).

3 Claims, 11 Drawing Sheets

(51) Int. Cl.

| | |
|---|---|
| ***B21C 37/08*** | (2006.01) |
| ***B21C 37/15*** | (2006.01) |
| ***B21D 51/16*** | (2006.01) |
| ***B21C 37/16*** | (2006.01) |
| ***B21C 37/18*** | (2006.01) |
| ***B21D 7/06*** | (2006.01) |

(52) U.S. Cl.
CPC ..... *B21C 37/15* (2013.01); *B21C 37/155* (2013.01); *B21C 37/16* (2013.01); *B21C 37/185* (2013.01); *B21D 5/01* (2013.01); *B21D 5/015* (2013.01); *B21D 51/16* (2013.01); *B21D 7/06* (2013.01)

(58) Field of Classification Search
CPC ..... B21C 37/16; B21C 37/185; B21C 37/286; B21D 5/01; B21D 5/015; B21D 5/1051; B21D 7/06
USPC ..... 72/367.1, 368, 369; 138/177, 178; 285/179
See application file for complete search history.

(56) References Cited

U.S. PATENT DOCUMENTS

| | | | | |
|---|---|---|---|---|
| 7,637,135 | B2 | 12/2009 | Homig et al. | |
| 2007/0175261 | A1 | 8/2007 | Hornig et al. | |
| 2012/0204619 | A1* | 8/2012 | Maeda | B21D 22/26 72/379.2 |
| 2015/0151344 | A1 | 6/2015 | Ueno et al. | |
| 2015/0165511 | A1 | 6/2015 | Higai et al. | |

FOREIGN PATENT DOCUMENTS

| | | | | | |
|---|---|---|---|---|---|
| JP | 51-134363 | A | | 11/1976 | |
| JP | 56-148416 | A | | 11/1981 | |
| JP | 57-165120 | A | | 10/1982 | |
| JP | 58-32010 | A | | 2/1983 | |
| JP | 59-73120 | A | | 4/1984 | |
| JP | 59073120 | A | * | 4/1984 | B21D 5/01 |
| JP | 9-155446 | A | | 6/1997 | |
| JP | 10-329503 | A | | 12/1998 | |
| JP | 10329503 | A | * | 12/1998 | |
| JP | 3114918 | B2 | | 12/2000 | |
| JP | 2008-80381 | A | | 4/2008 | |
| JP | 2009-513354 | A | | 4/2009 | |
| JP | 2012-254483 | A | | 12/2012 | |
| WO | WO 2005/002753 | A1 | | 1/2005 | |
| WO | WO 2013/111308 | A1 | | 8/2013 | |
| WO | WO-2013111308 | A1 | * | 8/2013 | B21D 5/015 |
| WO | WO 2013/179618 | A1 | | 12/2013 | |

OTHER PUBLICATIONS

EPO Machine Translation of JP 5973120 A (Year: 2019).*
Shaheen, Laurence; Tube Drawing Principles; Mar. 13, 2007 (Year: 2020).*
Canadian Office Action and Search Report, dated Jan. 30, 2019, for corresponding Canadian Application No. 2,960,938.
Korean Office Action dated Jul. 9, 2018 issued in corresponding Korean Patent Application No. 10-2017-7006722.
International Preliminary Report on Patentability and English translation of the Written Opinion of the International Searching Authority dated Mar. 21, 2017, issued in PCT/JP2015/076535 (Forms PCT/IB/373 and PCT/ISA/237).
International Search Report issued in PCT/JP2015/076535 dated Dec. 15, 2015 (Form PCT/ISA/210).
Japanese Office Action, dated Jul. 9, 2019, for corresponding Japanese Application No. 2018-195393, along with an English translation.
Brazilian Office Action for corresponding Brazilian Application No. BR112017005184-2, dated Feb. 4, 2020, with an English translation.
Indonesian Office Action for corresponding Indonesian Application No. P00201702403, dated Feb. 3, 2020, with an English translation.
Canadian Office Action for corresponding Canadian Application No. 3,029,423, dated Nov. 7, 2019.
Canadian Office Action for corresponding Canadian Application No. 3,029,423, dated Apr. 21, 2020.

* cited by examiner

FIG. 7A
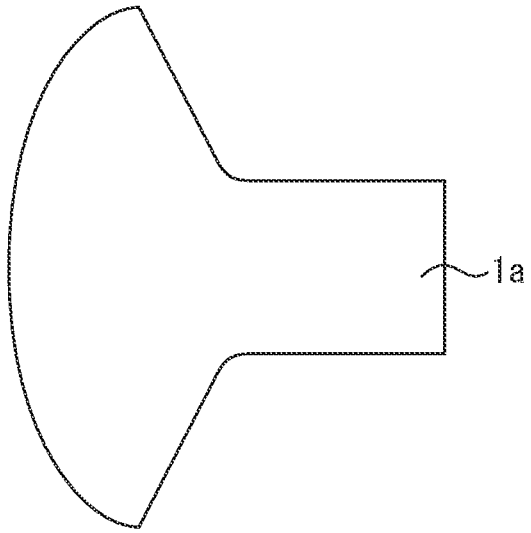
FIG. 7B
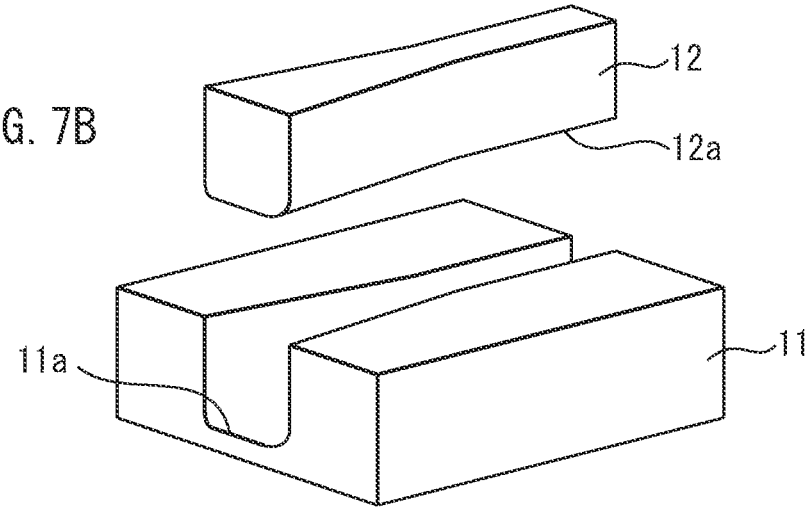
FIG. 7F
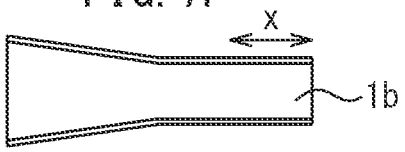
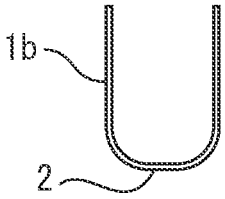
FIG. 7D
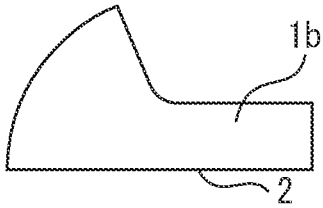
FIG. 7C
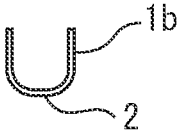
FIG. 7E FIG. 8A
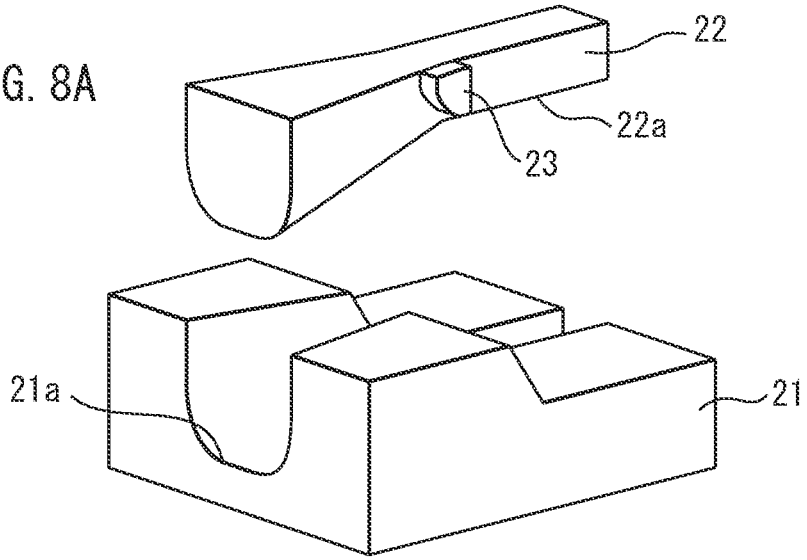
FIG. 8B
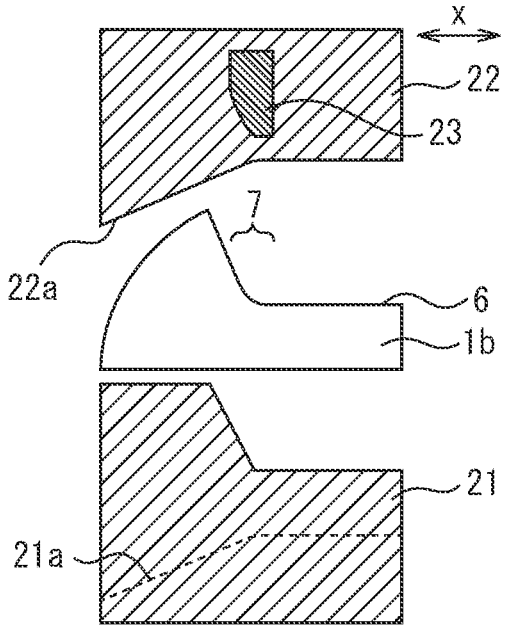
FIG. 8F
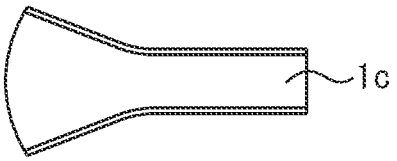
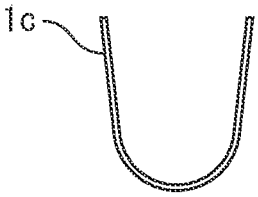
FIG. 8D
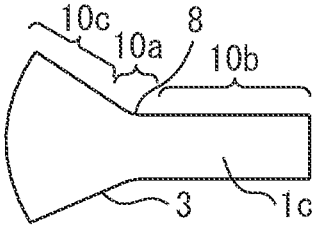
FIG. 8C
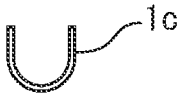
FIG. 8E FIG. 9A
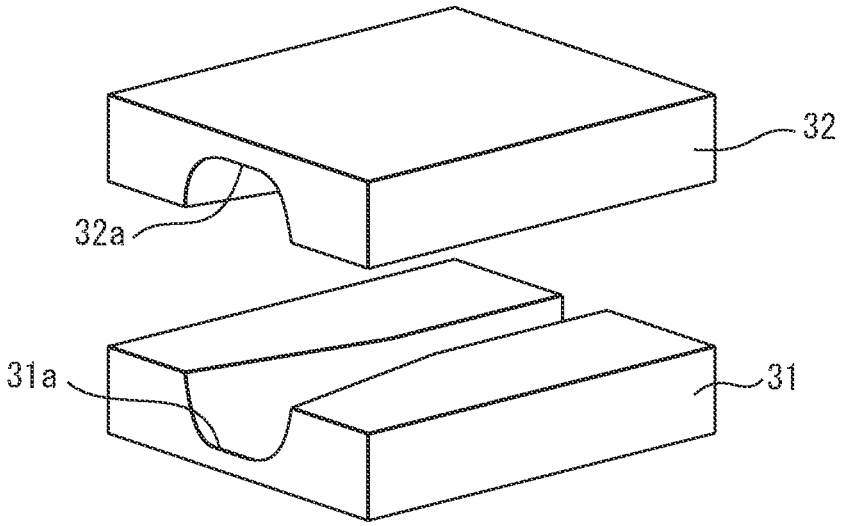
FIG. 9B
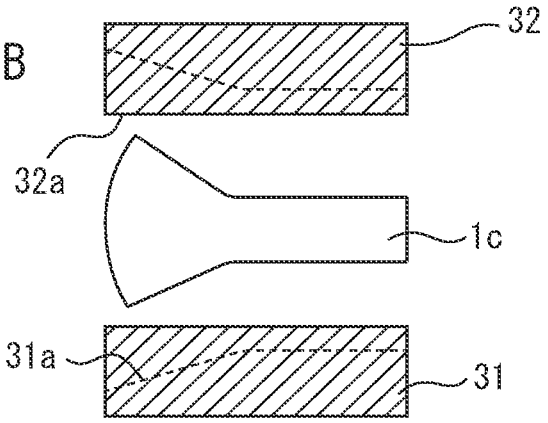
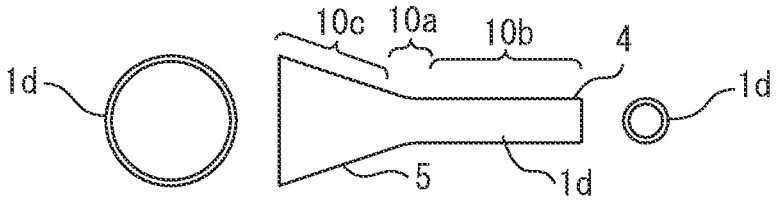
FIG. 9D FIG. 9C FIG. 9E FIG. 11D
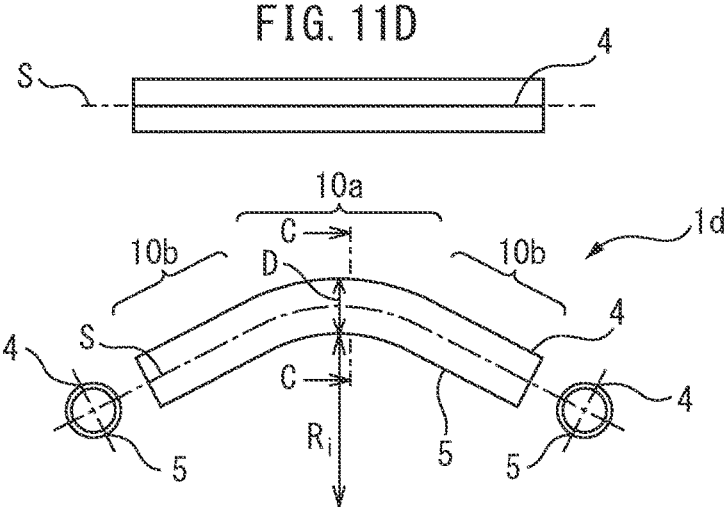
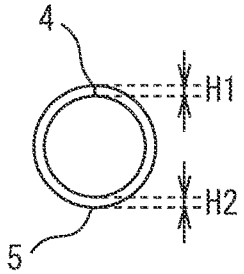
FIG. 11B FIG. 11A FIG. 11C FIG. 11E
FIG. 12D
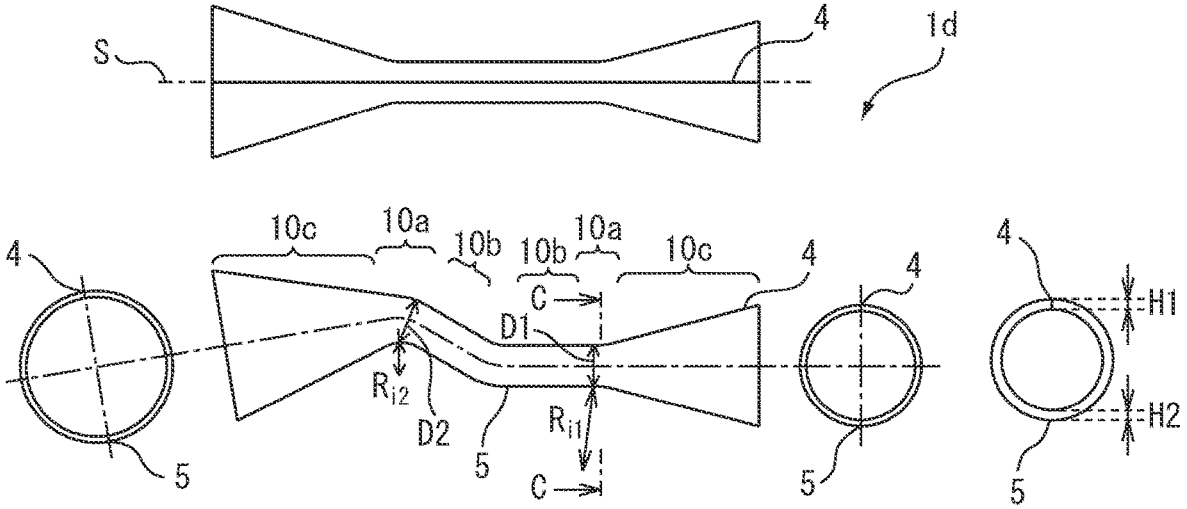
FIG. 12B FIG. 12A FIG. 12C FIG. 12E

METHOD OF PRODUCING SHAPED ARTICLE, TOOLING, AND TUBULAR SHAPED ARTICLE

TECHNICAL FIELD

The present invention relates to a method of producing a shaped article using a metal plate, tooling used for that method of production, and a tubular shaped article produced by that method of production.

BACKGROUND ART

Auto parts and household electric appliances first and foremost and vehicles, building materials, ships, etc. make frequent use of bent tubes having bent shapes, irregular diameter tubes having different outside diameters in the longitudinal direction, irregular cross-section tubes having different cross-sectional shapes in the longitudinal direction, and other tubular products. For this reason, technology for producing such tubular parts is being developed.

In the past, in the production of tubular parts, mainly straight shaped thick wall large diameter tubes have been UO-formed. For example, Japanese Patent Publication No. 58-32010A discloses the art of successively using a C-press, U-press, and O-press to form a straight shaped steel tube. However, with conventional UO-forming, forming a bent tube, irregular diameter tube, and irregular cross-section tube is difficult.

In recent years, UO-forming has been further improved to develop the art of forming a bent tube, irregular diameter tube, irregular cross-section tube, and other tubular parts having 3D shapes. For example, International Publication No. 2005/002753A proposes a method of using tooling provided with guide blades for edges in the vertical direction for UO-forming and producing straight shaped irregular diameter tubes. Further, Japanese Patent No. 3114918 and Japanese Patent Publication No. 2008-80381A propose a method of production of a curved hollow tube comprised of a method of bending the tube in the longitudinal direction at the time of U-forming the tube wherein the U-forming step is made a step including drawing process.

However, the method described in International Publication No. 2005/002753A is a method of production of a straight shaped irregular diameter tube. Formation of a bent tube is difficult. Further, the methods described in Japanese Patent No. 3114918 and Japanese Patent Publication No. 2008-80381A have the problems that the numbers of steps are large and the yields are low.

SUMMARY OF INVENTION

Technical Problem

With the method of bending in the longitudinal direction at the time of U-forming such as described in Japanese Patent No. 3114918 and Japanese Patent Publication No. 2008-80381A, depending on the shape or material of the shaped article, there is the problem of fracture or wrinkling during U-forming, creasing of the vertical walls, and other shaping defects.

The present invention was made in consideration of the above problem and has as its object the provision of a method of producing a shaped article able to suppress shaping defects when bending in the longitudinal direction to produce a shaped article, tooling used for that method of production, and a tubular shaped article obtained by that method of production.

Solution to Problem

To achieve the above object, the gist of the invention perfected by the inventors is as follows:

[1] A method of producing a shaped article comprising: a first step of press-forming a metal plate into a U-shape to obtain a U-shaped article having a bottom part straight extending in a longitudinal direction and a second step of press-forming said U-shaped article to bend it in the longitudinal direction so that the bottom part of the U-shaped article projects to an inside and to obtain a U-cross-section bent article.

[2] The method of producing a shaped article according to [1] characterized in that, in said second step, an external force in a direction connecting an edge and the bottom part is applied to at least a part of a planned bending part of said U-shaped article, at the same time as said bending.

[3] The method of producing a shaped article according to [2] characterized in that said external force is applied by compressing, in in-plane directions, said edge along the longitudinal direction of said U-shaped article toward the outside of the bottom part of said U-shaped article.

[4] The method of producing a shaped article according to any one of [1] to [3] further comprising a third step of shaping said U-cross-section bent article into a closed cross-section to obtain a tubular shaped article.

[5] A tooling for bending a U-shaped article in a longitudinal direction so that the bottom part projects to an inside and for obtaining a U-cross-section bent article, said tooling provided with a die, a punch, and pads arranged at side surfaces of said punch and compressing, in in-plane directions, at least parts of a planned bending part of said U-shaped article in end parts along the longitudinal direction of said U-shaped article.

[6] A tubular shaped article comprised of a metal plate and including only one seam extending in an axial direction, wherein a bottom part positioned at an opposite side to said seam in a peripheral direction includes a bent part projecting to an inside in an axial direction, and a ratio $H1/H2$ of a plate thickness $H1$ of said bent article at said seam and a plate thickness $H2$ of said bent article at said bottom part satisfies a following equation (1): $H1/H2 \geq Ri/(Ri+D)$ (1) (wherein in said equation (1), Ri is a radius of curvature of a bottom part side of the bent part, and D is a width of the bent part at a cross-section including a seam and a centerline of the tubular shaped article).

Advantageous Effects of Invention

In the method of producing a shaped article according to the present invention, U-forming and bending in the longitudinal direction are performed separately. Therefore, according to the method of producing a shaped article according to the present invention, it is possible to suppress shaping defects of the U-cross-section bent article and in turn possible to suppress shaping defects even in the shaped article. Note that, according to the tooling according to the present invention, it is possible to efficiently perform the above method of production and in turn possible to obtain a tubular shaped article according to the present invention.

BRIEF DESCRIPTION OF DRAWINGS

FIG. 7 are process diagrams showing another example of a first step in the method of producing a shaped article according to the present invention.

FIG. 8 are process diagrams showing another example of a second step in the method of producing a shaped article according to the present invention.

FIG. 9 are process diagrams showing an example of a third step in the method of producing a shaped article according to the present invention.

FIG. 11 are a schematic front view, side view, top view, and cross-sectional view of another example of a tubular shaped article according to the present invention.

FIG. 12 are a schematic front view, side view, top view, and cross-sectional view of another example of a tubular shaped article according to the present invention.

DESCRIPTION OF EMBODIMENTS

Figure 1A:
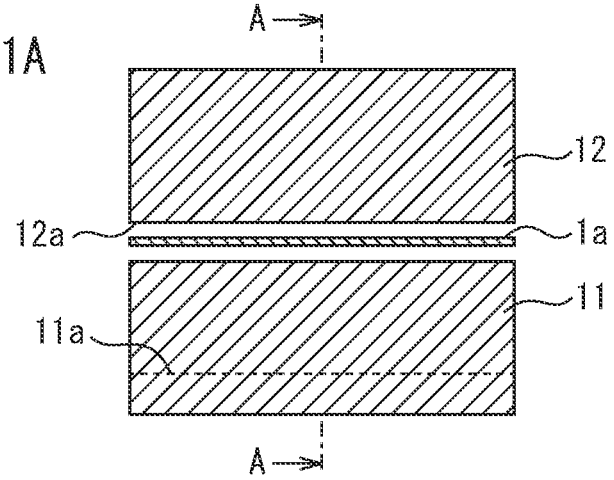
FIG. 1 are process diagrams showing an example of a first step and second step in the method of producing a shaped article according to the present invention.

Below, the method of producing a shaped article, tooling, and tubular shaped article according to the present invention will be explained in detail.

A. Method of Producing Shaped Article

Basic Embodiment

The method of producing a shaped article of the basic embodiment includes a first step of press-forming a metal plate into a U-shape to obtain a U-shaped article having a bottom part straight extending in a longitudinal direction and a second step of press-forming the U-shaped article to bend it in the longitudinal direction so that the bottom part of the part projects to the inside and obtain a U-cross-section bent article. Further, in the method of producing a shaped article of the basic embodiment, after the end of the above second step, for example, it is possible to perform a third step of shaping the above U-cross-section bent article into a closed cross-section to obtain a tubular shaped article. Note that, instead of the third step, piercing or burling, trimming, etc. can be performed. Further, piercing etc. can be performed before the first step, before the second step, or before the third step.

The method of producing a shaped article of the basic embodiment will be explained while referring to the drawings.

Figure 1B:
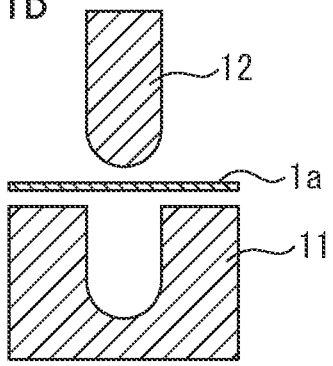
Figure 1C:
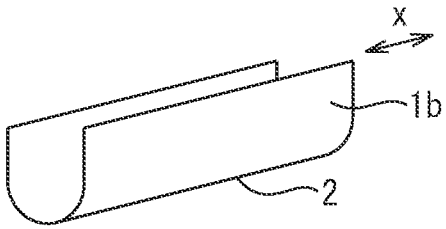
Figure 1D:
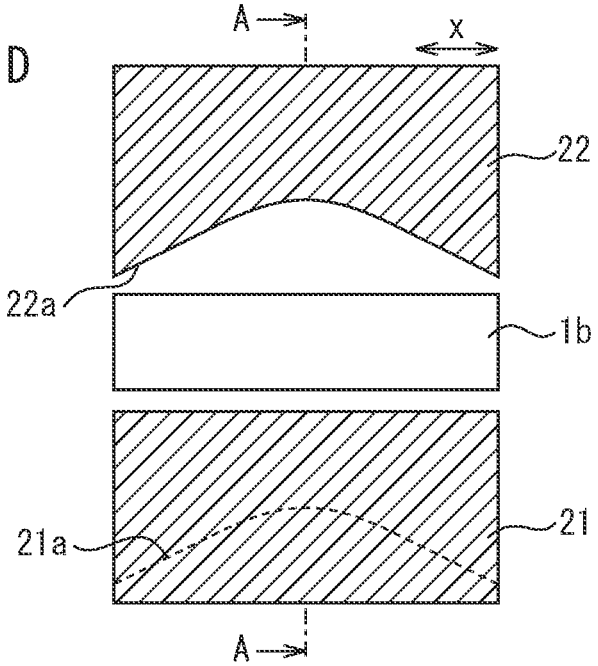
Figure 1E:
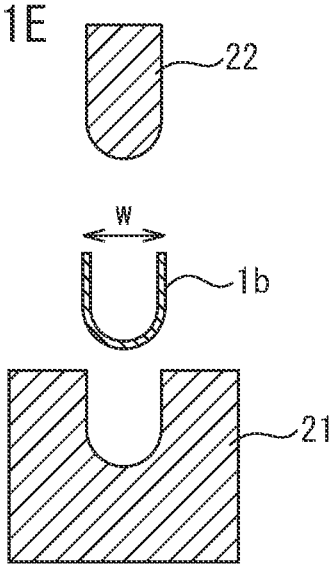
Figure 1F:
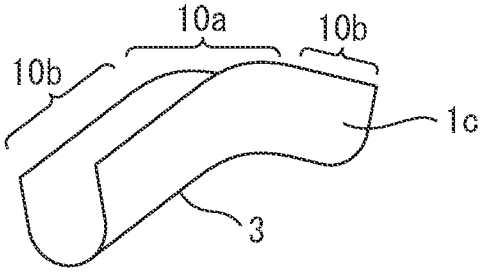
Figure 2A:
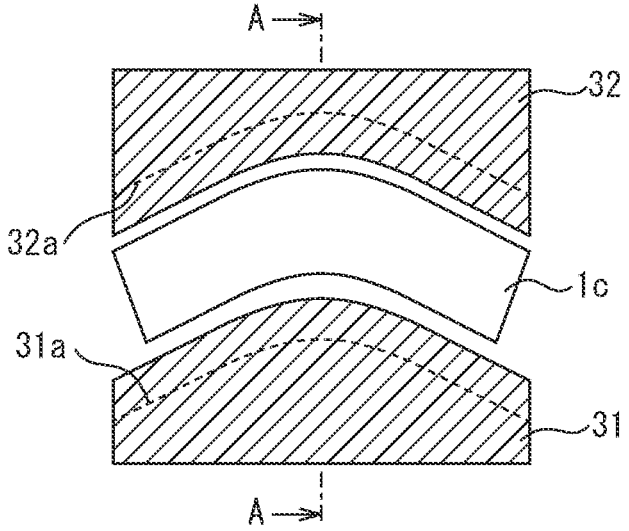
FIG. 2 are process diagrams showing an example of a third step in the method of producing a shaped article according to the present invention.
Figure 2B:
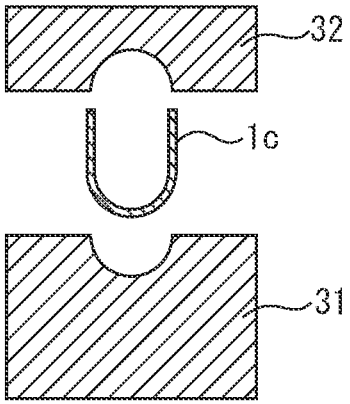
Figure 2C:
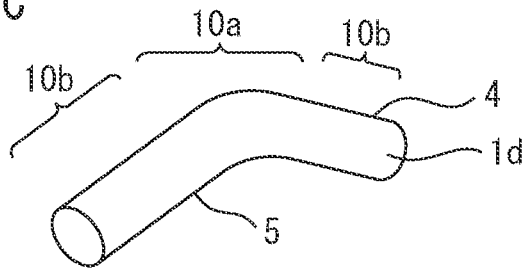

FIGS. 1A to 1F and FIGS. 2A to 2C are process diagrams showing one example of the method of producing a shaped article of the basic embodiment. FIGS. 1A and 1D are front views, FIG. 1B is a cross-sectional view along the line A-A of FIG. 1A, FIG. 1E is a cross-sectional view along the line A-A of FIG. 1D, FIGS. 10 and 1F are perspective views, FIG. 2A is a front view, FIG. 2B is a cross-sectional view along the line A-A of FIG. 2A, and FIG. 2C is a perspective view.

First, at the first step, as shown in FIGS. 1A and 1B, first tooling for U-forming use is prepared. The first tooling for U-forming use has a die 11 and punch 12. The bottom part 11*a* of the recessed part of the die 11 and the bottom part 12*a* of the punch 12 both extend straight in the longitudinal direction. Between the die 11 and punch 12 of the first tooling for U-forming use, a metal plate 1*a* is placed. The metal plate 1*a* is U-formed. Due to this, as shown in FIG. 1C, a U-shaped article 1*b* having a bottom part 2 extending straight in the longitudinal direction x is obtained.

Next, at the second step, as shown in FIGS. 1D and 1E, second tooling for bending use is prepared. The second tooling for bending use has a die 21 and punch 22. The bottom part 21*a* of the recessed part of the die 21 is formed curved projecting upward in the longitudinal direction. The bottom part 22*a* of the punch 22 is formed curved recessed in the longitudinal direction. Between the die 21 and punch 22 of this second tooling for bending use, the U-shaped article 1*b* is placed and the U-shaped article 1*b* is bent in the longitudinal direction x. Due to this, as shown in FIG. 1F, a U-cross-section bent article 1*c* is obtained. The U-cross-section bent article 1*c* is formed with the bottom part 3 curved projecting to the inside in the longitudinal direction. It has a bent part 10*a* with a bottom part 3 projecting inside in the longitudinal direction and a straight part 10*b* with a bottom part 3 extending straight in the longitudinal direction and having a total length of the U-shape in the U-cross-section equal along the centerline.

Next, at third step, as shown in FIGS. 2A and 2B, third tooling for O-forming use is prepared. The third tooling for O-forming use has a die 31 and punch 32. The bottom part 31*a* of the recess of the die 31 is formed curved projecting in the longitudinal direction, the bottom part 32*a* of the recess of the punch 32 is formed curved recessed in the longitudinal direction, and the recess of the die 31 and the recess of the punch 32 both have semicircular cross-sectional shapes. Between the die 31 and punch 32 of this third tooling for O-forming use, the U-cross-section bent article 1*c* is placed and the U-cross-section bent article 1*c* is O-formed. Due to this, as shown in FIG. 2C, a tubular shaped article 1*d* is obtained. The tubular shaped article 1*d* has a seam 4 formed curved projecting to the outside and a bottom part 5 positioned at the opposite side from the seam 4 in the peripheral direction formed curved projecting inside in the axial direction. It has a bent part 10*a* having a bottom part 5 projecting inside in the axial direction and a straight part 10*b* having a bottom part 5 extending straight in the axial direction and with an equal length in the peripheral direction along the centerline.

If, like in the past, performing the U-forming and bending in the longitudinal direction simultaneously, a force in a direction outside the plane easily acts on the vertical walls (straight parts at the ends of U-shape of worked object seen from side view) and creasing easily occurs at the edges (in particular near final edges of the straight parts). Further, in this case, the metal plate is bent in the plate width direction and is bent in the longitudinal direction as well, so a compressing force is generated at the bottom part in the substantially flat state and wrinkling easily occurs.

As opposed to this, in the basic embodiment according to the present invention, U-forming (first step) and bending in the longitudinal direction (second step) are performed in separate steps, so it is possible to decrease the force acting in the direction outside the plane on the vertical walls (straight parts of the two ends of the U-shaped article in the side view) at the time of bending of the second step and in turn it is possible to suppress the occurrence of creasing at the edges (in particular near final edges of the straight parts). Further, in the basic embodiment, the metal plate is not simultaneously bent in the plate width direction and longitudinal direction like in the past. The metal plate is bent once in the plate width direction to obtain a U-shaped article which is then bent in the longitudinal direction, so when bending in the longitudinal direction, it is possible to maintain the rigidity of the bottom part (U-shaped bottom part) at a high state. For this reason, stable bending in the longitudinal direction becomes possible, occurrence of wrinkling of the bent part at the bottom part can be suppressed, and in turn it is possible to obtain a U-cross-section bent article free of shaping defects and in turn a tubular shaped article.

Below, the different steps of the method of producing a shaped article of the basic embodiment will be explained in more detail.

(1) First Step

At the first step, the metal plate is press-formed into a U-shape to obtain a U-shaped article having a bottom part extending straight in the longitudinal direction. As the U-forming method, press-forming and roll forming can be employed.

The metal plate is not particularly limited so long as one able to be shaped. For example, a hot rolled steel plate, cold rolled steel plate, plated steel plate, etc. may be used. Further, for the metal plate, one comprised of a plurality of metal plates joined together, a so-called "tailored blank", may also be used. Further, a differential thickness steel plate can also be used. Further, a plate comprised of a plurality of metal plates superposed or a plate comprised of a metal plate with which a nonmetal material is superposed, that is, multilayer plates, may also be used.

The material of the metal plate is not particularly limited so long as one able to be shaped. For example, an Fe-based one (for example, carbon steel, stainless steel, etc.), an Al-based one (for example, Al or an alloy including Al and at least one of Cu, Mn, Si, Mg, Zn, etc.), a Cu-based one (for example, Cu or an alloy including Cu and at least one of Al, Ag, As, Be, Co, Cr, Fe, Mn, Ni, P, Pb, S, Se, Sd, Sn, Si, Te, Zn, Zr, etc.), a Ti-based one (for example, Ti or an alloy including Ti and at least one of N, C, H, Fe, O, Al, V, etc.), or other material may be mentioned.

The plate thickness of the metal plate need only be made an extent able to be shaped. While differing according to the material or the shape of the shaped article or the like, for example, it can be made within 0.5 mm to 30 mm in range. However, if the plate thickness is too small, at the time of bending, the bent part is liable to wrinkle or fracture, while if the plate thickness is too great, sometimes an excessive load is required for shaping operations, so the plate thickness is preferably made 1.0 mm to 5.0 mm.

Figure 3:
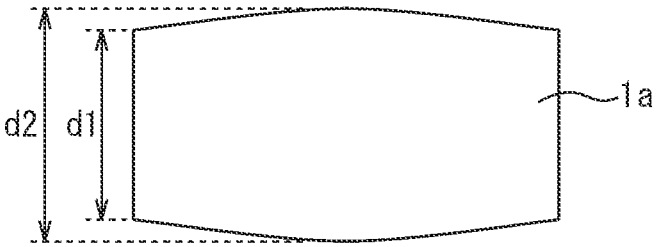
FIG. 3 is a schematic plan view showing one example of a metal plate used in the method of producing a shaped article according to the present invention.

The shape of the metal plate is suitably adjusted in accordance with the shape of the shaped article. For example, at the time of bending, the total length of the U-shape at the U-cross-section of the bent article decreases, so the plate width of the region to be the bent part of the metal plate is preferably designed so as to become larger than the targeted length of the U-cross-section of the U-cross-section bent article. Specifically, when fabricating the U-cross-section bent article 1*c* having the bent part 10*a* and straight part 10*b* shown in FIG. 1F, as shown in FIG. 3, it is preferable to design the plate width d2 of the region to be the bent part of the metal plate 1*a* larger than the plate width d1 of the region becoming the straight part.

The U-shaped article obtained at the first step has a bottom part extending straight in the longitudinal direction. At the cross-section of the U-shaped article in the longitudinal direction, the bottom part is formed straight.

(2) Second Step

At the second step, press-forming is used to bend the above U-shaped article in the longitudinal direction so that the above bottom part projects inside so as to obtain a U-cross-section bent article. As the bending method in this step, press-forming can be employed.

The radius of curvature at the bending differs according to the material, the shape of the shaped article or the like, but for example can be set in the range of 0.5 to 10 times the width of the U-cross-section. If the radius of curvature is small, the bent part is liable to wrinkle or fracture at the time of bending. Further, if the radius of curvature is large, the effect of performing the U-forming and bending in the longitudinal direction by separate steps (that is, suppress the occurrence of shaping defects) sometimes cannot be sufficiently obtained. Here, the "width of the U-cross-section" indicates the width w such as shown in FIG. 1E.

(3) Third Step

At the third step, the U-cross-section bent article is press-formed into a closed cross-section to obtain a tubular shaped article. Here, the "closed cross-section" is a concept including not only a completely closed cross-section but also the case where there is a clearance between the abutting edges. That is, at the seam of the tubular shaped article, the edges may be closely in contact or may be separated. That is, the seam may also have clearance.

As the method of forming the closed cross-section, press-forming can be employed. Further, when forming the closed cross-section, it is possible to use a mandrel in accordance with need. By using a mandrel, it is possible to stably form the tubular shaped article even if the cross-sectional shape of the peripheral direction is a complicated shape.

The tubular shaped article obtained at the third step has a bent part with a bottom part positioned at the opposite side from the seam in the peripheral direction and projecting inside in the axial direction. It is formed curved so that the bottom part projects inside in the cross-section of the axial direction. The seam may for example be formed curved so that it projects to the outside and may be formed straight.

The cross-sectional shape of the tubular shaped article in the peripheral direction is not particularly limited. It may be made a round shape, oval shape, square shape, vertically asymmetric shape, or various other shapes.

(4) Other Steps

In the basic embodiment, after the third step, it is also possible to perform a welding step of welding the seam of the tubular shaped article. As the welding method, for example, arc welding, laser welding, etc. may be mentioned. Further, in the basic embodiment, before the first step, edge bending of the metal plate, so-called curling or other processing may be performed.

(5) Shaped article

Figure 4A:
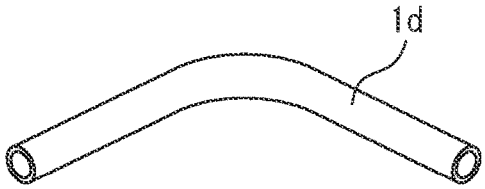
FIG. 4 are schematic perspective views showing an example of a tubular shaped article according to the present invention.
Figure 4B:
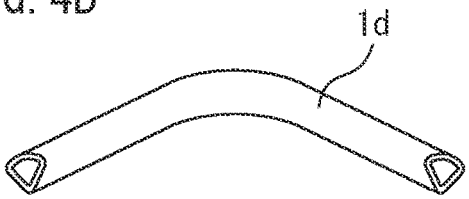

The shaped article produced by the basic embodiment is a tubular shaped article. Further, the shape of the tubular shaped article is not particularly limited so long as one is able to be formed well by the method of the basic embodiment. For example, a bent tube with a circular cross-sectional shape in the peripheral direction such as shown in FIG. 4A, a bent tube with a vertically asymmetric cross-sectional shape in the peripheral direction such as shown in FIG. 4B, a not shown irregular diameter tube or irregular cross-section tube etc. may be illustrated.

Due to the above, according to the method of producing a shaped article shown in FIG. 1 and FIG. 2 (basic embodiment), in particular, at the second step, U-forming and bending in the longitudinal direction can be separately performed so as to suppress the occurrence of shaping defects.

APPLIED EMBODIMENTS

Next, the Applied Embodiments 1 and 2 improved over the above basic embodiment will be explained in detail.

Applied Embodiment 1: Modification Applying to at Least Part of Planned Bending Part of U-Shaped Article External Force in Directions Connecting Edges and Bottom Part In the method of producing a shaped article of the Applied Embodiment 1, in the second step explained in the basic embodiment, at the same time as the bending, external force in directions connecting the edges and bottom part is applied to at least part of the planned bending part of the U-shaped article. Here, the "planned bending part of the U-shaped article" means the region corresponding to the region to be the bent part in the U-cross-section bent article obtained at the time of end of the second step. Further, the "outside of the bottom part" means the side in the direction of movement of the punch at the time of bending.

As such an example of "at the same time as the bending, external force in directions connecting the edges and bottom part is applied to at least parts of the planned bending part of the U-shaped article", the type of "applying the external force by compressing the edges along the longitudinal direction of the U-shaped article toward the outside of the bottom part of the U-shaped article in the planar direction" and the type of "applying the external force by pulling the vertical walls of the U-shaped article toward the inside of the bottom part of the U-shaped article (direction opposite to direction of movement of punch at time of bending) in the planar direction" may be mentioned.

The method of producing a shaped article of the Applied Embodiment 1 will be explained while referring to the drawings. Note that, below, the type of "applying the external force at the second step by compressing the edges along the longitudinal direction of U-shaped article toward the outside of the bottom part of the U-shaped article in the planar direction" will be explained in detail.

Figure 5A:
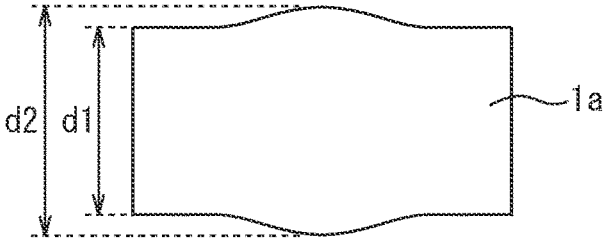
FIG. 5 are process diagrams showing an example of a first step in the method of producing a shaped article according to the present invention.
Figure 5B:
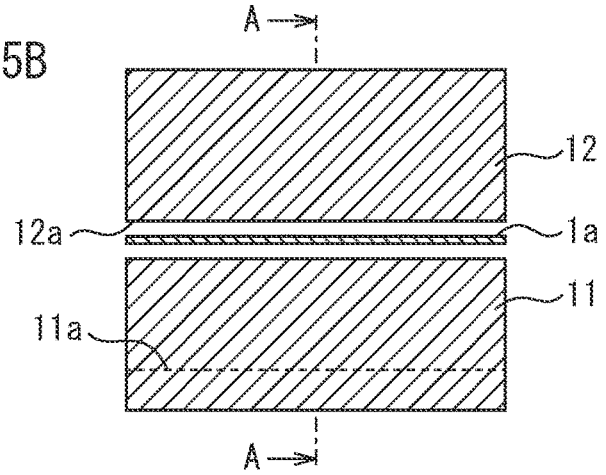
Figure 5C:
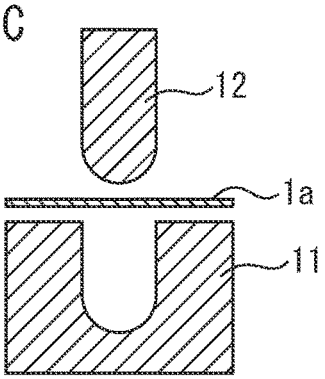
Figure 5D:
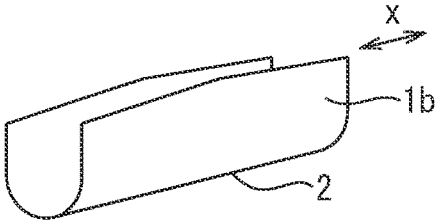
Figure 6A:
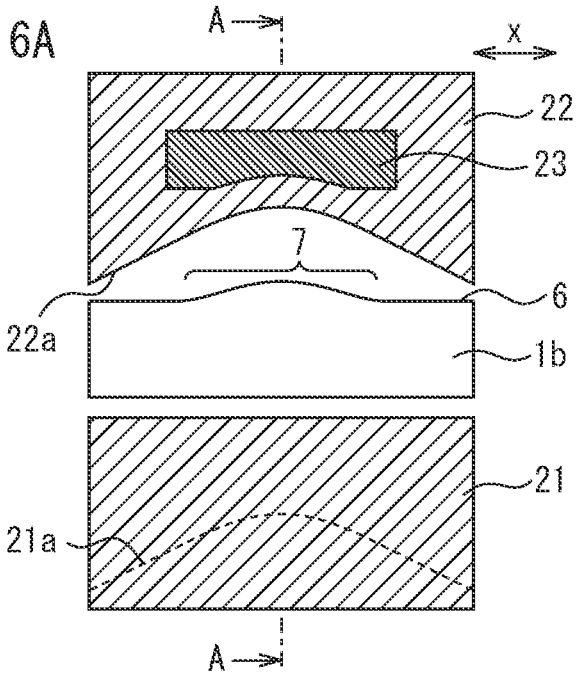
FIG. 6 are process diagrams showing an example of a second step in the method of producing a shaped article according to the present invention.
Figure 6B:
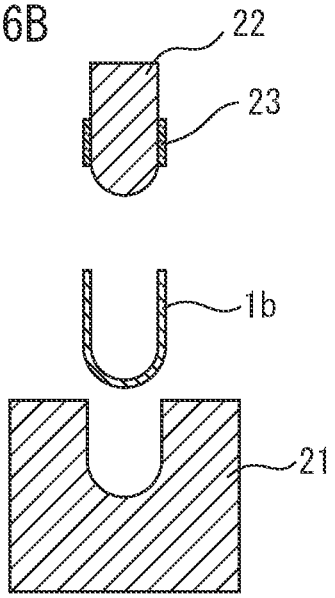
Figure 6C:
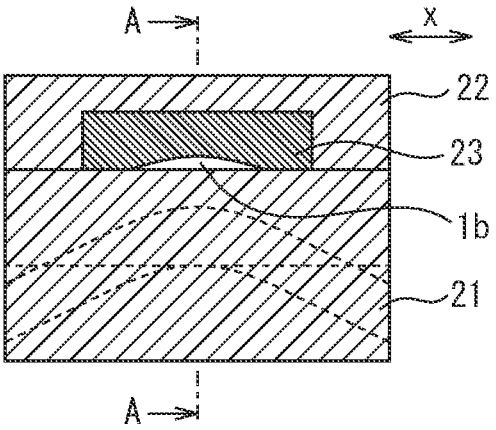
Figure 6D:
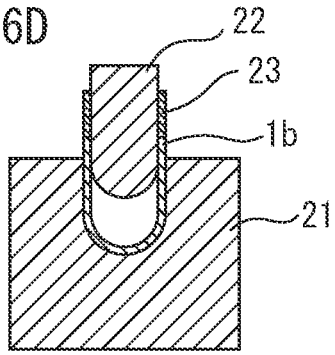
Figure 6E:
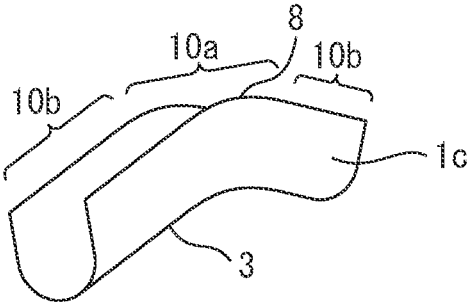

FIGS. 5A to 5D and FIGS. 6A to 6E are process diagrams showing an example of the method of producing a shaped article of the present embodiment. FIG. 5A is a top view, FIG. 5B is a front view, FIG. 5C is a cross-sectional view along the line A-A of FIG. 5B, and FIG. 5D is a perspective view. Further, FIGS. 6A and 6C are front views, FIG. 6B is a cross-sectional view along the line A-A of FIG. 6A, FIG. 6D is a cross-sectional view along the line A-A of FIG. 6C, and FIG. 6E is a perspective view.

First, as shown in FIG. 5A, a metal plate 1*a* with a plate width d2 of the planned bending part (region to be a bent part) larger than the plate width d1 of the region becoming the straight part is prepared.

Next, at first step, as shown in FIGS. 5B and 5C, first tooling for U-forming use is prepared. The first tooling for U-forming use has a die 11 and punch 12. The bottom part 11*a* of the recessed part of the die 11 and the bottom part 12*a* of the punch 12 both extend straight in the longitudinal direction. The metal plate 1*a* is placed between the die 11 and punch 12 of the first tooling for U-forming use and the metal plate 1*a* is U-formed. Due to this, as shown in FIG. 5D, a U-shaped article 1*b* having a bottom part 2 extending straight in the longitudinal direction x is obtained.

Furthermore, at the second step, as shown in FIGS. 6A and 6B, second tooling for bending use is prepared. The second tooling for bending use has a die 21, punch 22, and pads 23 arranged at the two side surfaces of the punch 22. The bottom part 21*a* of the recess of the die 21 is formed curved projecting in the longitudinal direction, while the bottom part 22*a* of the punch 22 is formed curved recessed in the longitudinal direction.

The pads 23 compress at least parts of the planned bending part (in U-cross-section bent article, region to be a bent part) 7 of the U-shaped article 1*b* at the edges 6 in the longitudinal direction x of the U-shaped article 1*b* in the planar direction and can move up and down. In the example shown in FIG. 6, the pads 23 are a type compressing the entire part of the planned bending part 7, but the pads according to the present invention are not limited to such a type. They may also be a type compressing parts of the planned bending part 7.

Next, as shown in FIGS. 6A to 6D, the U-shaped article 1*b* is placed between the die 21 and punch 22 of the second tooling for bending use, then the U-shaped article 1*b* is bent in the longitudinal direction x. At this time, at least parts of the planned bending part 7 of the U-cross-section bent article at the edges 6 of the U-shaped article 1*b* in the longitudinal direction x are compressed in the planar direction. Due to this, as shown in FIG. 6E, a U-cross-section bent article 1*c* is obtained. The U-cross-section bent article 1*c* has a bottom part 3 formed curved projecting inside in the longitudinal direction. It has a bent part 10*a* with a bottom part 3 projecting inside in the longitudinal direction and a straight part 10*b* having a bottom part 3 extending straight in the longitudinal direction and with an equal U-cross-section along the centerline.

Due to the above, according to the method of producing a shaped article shown in FIG. 5 and FIG. 6 (Applied Embodiment 1), not only the effect exhibited by the above basic embodiment of "suppressing the occurrence of shaping defects", in particular, not only the effect that at the second step, by applying external force to at least parts of the planned bending part of the U-shaped article toward the outside of the bottom part of the U-shaped article, it is possible to suppress local changes in the plate thickness in the U-cross-section bent article, that is, decrease of thickness and increase of thickness, but also it is possible to further suppress the occurrence of wrinkling at the bottom part of the bent part. Further, by going through a third step in the same way as the basic embodiment, a desired tubular shaped article can be obtained.

Here, the specific grounds why it is possible to suppress local changes in the plate thickness, that is, decrease of thickness and increase of thickness, for the worked part 1*c* shown in FIG. 6E, are as follows: That is, in Applied Embodiment 1, at the second step, by using the pads 23 to compress at least parts of the planned bending part 7 in the planar direction, at least parts of the bottom part of the planned bending part are pressed against the tooling and the neutral axis of bending (position not stretching or contracting in longitudinal direction) moves to the bottom part side compared with the case of not compressing in the planar direction. For this reason, in the worked part 1*c* shown in FIG. 6E, not only it is possible to suppress the increase in plate thickness at the bottom part 3 side at the bent part 10*a*, but also it is possible to suppress the decrease in plate thickness due to material being supplied by compressing to the edge 8 side along the longitudinal direction. Therefore, not only is it possible to suppress the occurrence of fractures at the edge along the longitudinal direction of the bent part 10*a* and wrinkling at the bottom part, but it also possible to make the distribution of plate thickness of the U-cross-section of the U-cross-section bent article uniform.

In this way, in the Applied Embodiment 1, it is possible to make the distribution of plate thickness uniform, so it is possible to enlarge the range of possible shaping of the bent part in the longitudinal direction of the U-cross-section bent article 1*c* compared with the basic embodiment. For this reason, for example, a U-cross-section bent article having a bent part with the relatively small radius of curvature and a U-cross-section bent article having a taper part also can suppress the occurrence of wrinkling and fracture while enabling stable shaping.

Furthermore, when compressing at least parts of the planned bending part at the edges along the longitudinal direction of the U-shaped article (region to be a bent part of U-cross-section bent article) in the planar direction, it is not necessary to constantly apply pressure during bending. It is sufficient to apply pressure at any time during bending.

In addition, as the pressure at the time of compressing at least parts of the planned bending part at the edges along the longitudinal direction of the U-shaped article in the planar direction, one of an extent enabling suppression of the decrease of plate thickness at the edges along the longitudinal direction of the bent part and increase of plate thickness at the bottom part is sufficient. It may be suitably adjusted in accordance with the shape of the shaped article, the shape of the pads of the bending-use second tooling, the plate thickness or material of the metal plate, etc.

Applied Embodiment 2: Modification Relating to Shape of Tubular Shaped Article The method of producing a shaped article of the Applied Embodiment 2 is a method of production improving the shape of the shaped article obtained in the basic embodiment and Applied Embodiment 1.

FIGS. 7A to 7F and FIGS. 8A to 8F are process diagrams showing an example of the method of producing a shaped article of the Applied Embodiment 2. FIG. 7A is a top view, FIG. 7B is a perspective view, FIG. 7C is a front view, FIG. 7D is a left side view of FIG. 7C, FIG. 7E is a right side view of FIG. 7C, and FIG. 7F is a top view of FIG. 7C. Further, FIG. 8A is a perspective view, FIG. 8B is a front view, FIG. 8C is a front view, FIG. 8D is a left side view of FIG. 8C, FIG. 8E is a right side view of FIG. 8C, and FIG. 8F is a top view of FIG. 8C.

First, the metal plate 1*a* such as shown in FIG. 7A is prepared.

Next, at a first step, as shown in FIG. 7B, first tooling for U-forming use is prepared. The first tooling for U-forming use has a die 11 and punch 12. The bottom part 11*a* of the recessed part of the die 11 and the bottom part 12*a* of the punch 12 both extend straight in the longitudinal direction. A metal plate 1*a* is placed between the die 11 and punch 12 of the first tooling for U-forming use, then the metal plate 1*a* is U-formed. Due to this, as shown in FIGS. 7C to 7F, a U-shaped article 1*b* having a bottom part 2 extending straight in the longitudinal direction x is obtained.

Further, in the second step, as shown in FIGS. 8A and 8B, second tooling for bending use is prepared. The second tooling for bending use has a die 21, punch 22, and pads 23 arranged at the two side surfaces of the punch 22. The bottom part 21*a* of the recessed part of the die 21 is formed curved projecting in the longitudinal direction, while the bottom part 22*a* of the punch 22 is formed curved recessed in the longitudinal direction. The pads 23 compress the region to be the bent part 7 of the U-cross-section bent article of the edge 6 along the longitudinal direction x of the U-shaped article 1*b* in the planar direction and can move up and down.

Next, as shown in FIG. 8B, the U-shaped article 1*b* is placed between the die 21 and punch 22 of the second tooling for bending use and the U-shaped article 1*b* is bent in the longitudinal direction x. At this time, the region to be the bent part 7 of the U-cross-section bent article of the edge 6 along the longitudinal direction x of the U-shaped article 1*b* is compressed in the planar direction. Due to this, as shown in FIGS. 8C to 8F, a U-cross-section bent article 1*c* is obtained. The U-cross-section bent article 1*c* has a bottom part 3 formed curved projecting inside in the longitudinal direction. It has a bent part 10*a* with a bottom part 3 projecting inside in the longitudinal direction, a straight part 10*b* having a bottom part 3 extending straight in the longitudinal direction and having an equal length of the U-cross-section along the centerline, and a taper part 10*c* having and a bottom part 3 extending straight in the longitudinal direction and having a length of the U-cross-section increasing along the centerline.

In the Applied Embodiment 2, in the same way as the Applied Embodiment 1, when bending the U-shaped article at the second step to obtain the U-cross-section bent article, the U-shaped article is bent and at least part of the planned bending part (region to be a bent part) of the above U-cross-section bent article is compressed in the planar direction.

Due to the above, according to the method of producing a shaped article shown in FIG. 7 and FIG. 8 (Applied Embodiment 2), in the same way as the Applied Embodiment 1, not only is there the effect exhibited by the basic embodiment of "suppressing the occurrence of shaping defects", in particular, at the second step, by applying external force to at least parts of the planned bending part of the U-shaped article toward the outside of the bottom part of the U-shaped article, it is possible to suppress local changes in the plate thickness in the U-cross-section bent article, that is, decrease of thickness. Further, by going through a third step in the same way as the basic embodiment and Applied Embodiment 1, a desired tubular shaped article can be obtained.

Here, the third step in the Applied Embodiment 2 will be explained in detail. That is, in the above formed U-cross-section bent article (FIG. 8C to FIG. 8F), further, as shown in FIG. 9, the U-cross-section bent article is shaped to a closed cross-section.

FIG. 9A is a perspective view, FIG. 9B is a front view, FIG. 9C is a front view, FIG. 9D is a left side view of FIG. 9C, and FIG. 9E is a right side view of FIG. 9C.

At the third step, as shown in FIGS. 9A and 9B, third tooling for O-forming use is prepared. The third tooling for O-forming use has a die 31 and punch 32, the bottom part 31*a* of the recessed part of the die 31 is formed curved projecting in the longitudinal direction, the bottom part 32*a* of the recessed part of the punch 32 is formed curved recessed in the longitudinal direction, and both the recessed part of the die 31 and the recessed part of the punch 32 have semicircular cross-sectional shapes.

A U-cross-section bent article 1*c* is placed between the die 31 and punch 32 of the third tooling for O-forming use, and the U-cross-section bent article 1*c* is O-formed. Due to this, as shown in FIGS. 9C to 9E, a tubular shaped article 1*d* is obtained. The tubular shaped article 1*d* has a seam 4 formed curved projecting inside and has a bottom part 5 positioned at the opposite side from the seam 4 in the peripheral direction and formed curved projecting inside in the axial direction. It has a bent part 10*a* having a bottom part 5 projecting inside in the axial direction, a straight part 10*b* having a bottom part 5 extending straight in the axial direction and having an equal length in the peripheral direction along the centerline, and a taper part 10*c* having a bottom part 5 extending straight in the axial direction and having a length in the peripheral direction increasing along the centerline.

Due to the basic embodiment and Applied Embodiments 1 and 2 shown above, various shaped articles are obtained. That is, as the obtained shaped articles, there are various shapes of tubular shaped articles obtained through various shapes of U-cross-section bent articles. These are suitably selected in accordance with the presence/absence of the third step, welding step, etc.

Figure 10A:
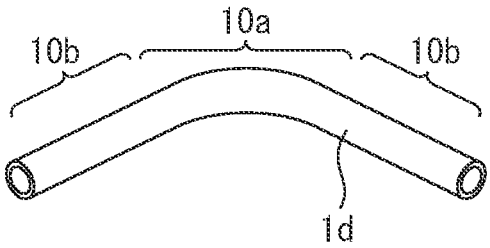
FIG. 10 are schematic perspective views showing another example of a tubular shaped article according to the present invention.
Figure 10B:
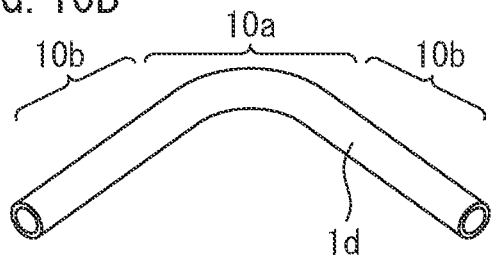
Figure 10C:
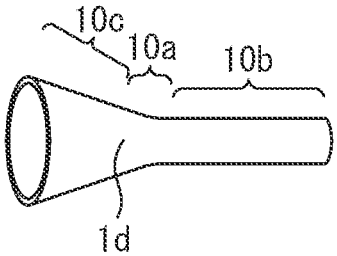
Figure 10D:
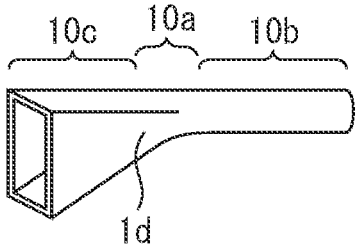
Figure 10E:
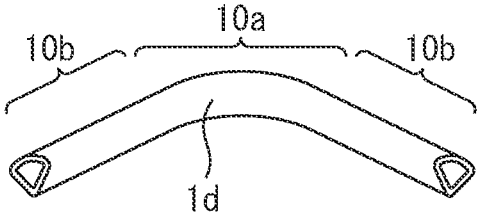
Figure 10F:
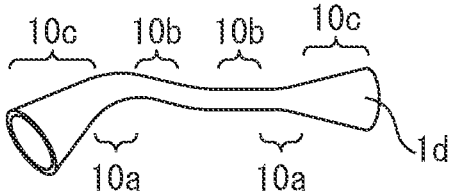

Further, as the shape of the shaped article, for example, in the case of the tubular shaped article 1*d*, a bent tube such as shown in FIGS. 10A and 10B having a cross-sectional shape in the peripheral direction of a circular shape and having a bent part 10*a* and straight part 10*b*, a trumpet-shaped irregular diameter tube such as shown in FIG. 100 having a cross-sectional shape in the peripheral direction of a circular shape and having a bent part 10*a*, straight part 10*b*, and taper part 10*c*, a trumpet-shaped irregular diameter tube such as shown in FIG. 10D having a cross-sectional shape in the peripheral direction changing from a circular shape to a square shape and having a bent part 10*a*, straight part 10*b*, and taper part 10*c*, a bent tube such as shown in FIG. 10E having a cross-sectional shape in the peripheral direction of a vertically asymmetrical shape and having a bent part 10*a* and straight part 10*b*, an irregular diameter tube such as shown in FIG. 10F having pluralities of bent parts 10*a*, straight parts 10*b*, and taper parts 10*c* can be mentioned.

B. Tooling

The tooling according to the present invention is for bending a U-shaped article in the longitudinal direction so that the bottom part projects inside so as to obtain a U-cross-section bent article and is characterized by the provision of a die, a punch, and pads arranged at side surfaces of the above punch and compressing at least parts of the planned bending part of the U-shaped article at the edged along the longitudinal direction of the U-shaped article in the planar direction. That is, the tooling according to the present invention is used in the second step of the method of producing a shaped article in the above Applied Embodiments 1 and 2.

FIGS. 6A and 6B show an example of tooling according to the present invention, while FIGS. 8A and 8B show another example of tooling according to the present invention. As shown in FIGS. 6A and 6B (FIGS. 8A and 8B), the tooling has a die 21, punch 22, and pads 23 arranged at the two side surfaces of the punch 22. The bottom part 21*a* of the recessed part of the die 21 is formed curved projecting in the longitudinal direction, while the bottom part 22*a* of the punch 22 is formed curved recessed in the longitudinal direction. The pads 23 compress at least parts of the planned bending part 7 of the U-shaped article at the edges 6 along the longitudinal direction x of the U-shaped article 1*b* in the planar direction and can move up and down.

In the tooling according to the present invention, by having the above such predetermined pads, at the time of bending using the tooling, the pads can compress at least parts of the planned bending part at the edges along the longitudinal direction of the U-shaped article in the planar direction. For this reason, in the U-cross-section bent article 1*c* shown in FIG. 6E and FIGS. 8C to 8F, it is possible to suppress the decrease in plate thickness at the bent part 10*a* at the edges 8 along the longitudinal direction and the increase in plate thickness at the bottom part 3. Therefore, by using the tooling according to the present invention, it is possible to suppress the occurrence of wrinkling at the bottom part of the bent part and fracture at the edges along the longitudinal direction to a high level. Not only that, it is possible to make the distribution of plate thickness at the U-cross-section of the U-cross-section bent article uniform. Due to this, by using the tooling according to the present invention, it is possible to suitably enlarge the possible range of shaping of the bent article in the longitudinal direction of the U-cross-section bent article 1*c* (number of types of shapes and extent of complexity of parts which can be formed) compared with the past. Due to this, for example, even with a U-cross-section bent article having a bent part with a relatively small radius of curvature or a U-cross-section bent article having a taper part, it is possible to suppress the occurrence of wrinkling or fracture and in turn possible to suppress the occurrence of shaping defects at a high level.

Below, the different components in the tooling according to the present invention will be explained.

1. Pads

The pads are arranged at the two side surfaces of the punch and compress at least parts of the planned bending part at the edges along the longitudinal direction of U-shaped article in the planar direction.

The parts where the pads abut against the U-shaped article are made at least parts of the planned bending part (that is, region to be a bent part in U-cross-section bent article) of the edges along the longitudinal direction of the U-shaped article. If the planned bending part is too broad, even untargeted regions end up being compressed in the planar direction and shaping defects are liable to occur. Further, if the planned bending part is too narrow, the reduction of plate thickness at the edges along the longitudinal direction of the bent part and increase of plate thickness at the bottom part could not be sufficiently suppressed. Not only cannot shaping defects be suppressed to a high level, but also it becomes difficult to make the distribution of plate thickness of the U-cross-section uniform.

The shapes of the parts of the pads abutting against the shaped article need only be shapes enabling at least parts of the planned bending part at the edges along the longitudinal direction of the U-shaped article to be compressed in the planar direction. It is possible to suitably design them in accordance with the shapes etc. of the U-shaped article. Along with the bending of the U-shaped article, the U-shaped article changes in shape and the edges along the longitudinal direction of the U-shaped article also change in shape. For this reason, for example, if assuming the shapes of the edges along the longitudinal direction of the U-shaped article at the initial stage, middle stage, and later stage of bending, the shapes of the parts of the pads abutting against the U-shaped article are preferably shapes corresponding to the shapes of the edges along the longitudinal direction of the U-shaped article at the initial stage or middle stage of bending. If the shapes of the parts of the pads abutting against the U-shaped article are shapes corresponding to the shapes of the edges along the longitudinal direction of the shaped articles at the later stage of bending, due to the pads, sometimes it becomes difficult to compress at least parts of the planned bending part of the edges along the longitudinal direction of the U-shaped article in the planar direction.

Further, the pads may be divided into pluralities of blocks along the direction of advance of the pads. In this case, by making the individual blocks forming the pads move up and down, it is possible to change the shapes of the parts of the pads abutting against the U-shaped article along with the change of shapes of the edges of the U-shaped article during the bending.

Further, the parts of the pads abutting against the U-shaped article may have elastic members arranged at them. In this case, it is possible to make the elastic members elastically deform along with the changes in shapes of the edges of the U-shaped article during bending. As the material of the elastic members, for example, hard rubber, urethane, resin materials, etc. may be mentioned.

The pads are arranged at the two side surfaces of the punch. The pads may be formed integrally with the punch or may be arranged independently from the punch. Even if the pads are formed integrally with the punch and are fixed to the punch, the pads can be used to compress at least parts of the planned bending part at the edges along the longitudinal direction of the U-shaped article in the planar direction, so the effect is obtained of suppressing the reduction in plate thickness of the edges along the longitudinal direction of U-cross-section bent article and the increase in plate thickness of the bottom part. In particular, the pads being arranged independently from the punch and the pads and punch being able to individually move up and down are preferable from the viewpoint of being able to freely control the timings of bending in the longitudinal direction and the compressing of the edges.

Further, the pads are preferably attached to the punch or a press system (system controlling relative positions of die and punch) through springs etc. so as to be able to move up and down relative to the punch.

As the material of the pads, it is possible to make it similar to the material of the general tooling.

2. Die and Punch

The die and punch need only bend the U-shaped article in the longitudinal direction so that the bottom part projects inside to obtain the U-cross-section bent article. It is possible to suitably design them according to the shape etc. of the shaped article.

C. Tubular Shaped Article

The tubular shaped article according to the present invention is comprised of a metal plate and has only one seam extending in the axial direction. It has a bent part with a bottom part projecting inside in the axial direction positioned at the opposite side to the above seam in the peripheral direction. The ratio H1/H2 of the plate thickness H1 of the above bent part at the above seam and the plate thickness H2 of the above bent part at the above bottom part satisfies the following equation (2):

$$H1/H2 \geq Ri/(Ri+D) \quad (2)$$

(wherein in the above equation (2), Ri is the radius of curvature of the bottom part side of the bent part and D is the width of the bent part of the cross-section including the seam and centerline of the tubular shaped article)

FIGS. 11A to 11E are views showing one example of a tubular shaped article according to the present invention, wherein FIG. 11A is a front view, FIG. 11B is a left side view, FIG. 11C is a right side view, FIG. 11D is a top view, and FIG. 11E is a cross-sectional view along the line C-C of FIG. 11A. The tubular shaped article 1*d* shown in FIGS. 11A to 11E is comprised of a metal plate. It has only one seam 4 extending in the axial direction and is comprised of a single metal plate formed into a tubular shape. The tubular shaped article 1*d* has a bent part 10*a* having a bottom part 5 positioned at the opposite side to the seam 4 in the peripheral direction projecting inside in the axial direction and a straight part 10*b* having a bottom part 5 extending straight in the axial direction and having an equal length in the peripheral direction along the centerline S. Further, the ratio H1/H2 of the plate thickness H1 at the seam 4 of the bent part 10*a* and the plate thickness H2 at the bottom part 5 of the bent part 10*a* is a predetermined range.

FIGS. 12A to 12E are views showing another example of a tubular shaped article according to the present invention, wherein FIG. 12A is a front view, FIG. 12B is a left side view, FIG. 12C is a right side view, FIG. 12D is a top view, and FIG. 12E is a cross-sectional view along the line C-C of FIG. 12A. The tubular shaped article 1*d* shown in FIGS. 12A to 12E is comprised of a metal plate. It has only one seam 4 extending in the axial direction. A single metal plate is formed into a tubular shape. The tubular shaped article 1*d* has a bent part 10*a* having a bottom part 5 positioned at the opposite side to the seam 4 in the peripheral direction and projecting inside in the axial direction, a straight part 10*b* having a bottom part 5 extending straight in the axial direction and having an equal length in the peripheral direction along the centerline S, and a taper part 10*c* having a bottom part 5 extending straight in the axial direction and increasing in length in the peripheral direction along the centerline S. There are pluralities of the bent part 10*a*, straight part 10*b*, and taper part 10*c*. Further, in the bent part 10*a*, in any case, the ratio H1/H2 of the plate thickness H1 at the seam 4 of the bent part 10*a* and the plate thickness H2 at the bottom part 5 of the bent part 10*a* is a predetermined range.

Here, when bending the U-shaped article, with a tubular shaped article obtained without compressing the planned bending part of the edge along the longitudinal direction of the U-shaped article at all in the planar direction, usually, H1/H2 becomes less than Ri/(Ri+D) and the above equation (2) is not satisfied. This is because in general, at the time of bending, at the seam of the bent part (outside of bending), a tensile stress acts, so the plate thickness easily decreases and at the bottom part of the bent part (inside of bending), compressive stress acts, so the plate thickness easily increases. As opposed to this, in a tubular shaped article according to the present invention, H1/H2 satisfies the above equation (2), so at the bent part, a uniform distribution of plate thickness can be obtained. Therefore, according to the tubular shaped article according to the present invention, not only is it possible to suppress the occurrence of fractures at the seam and wrinkling at the bottom part of the bent part to a high level and eliminate shaping defects, but also it is possible to make the distribution of plate thickness in the peripheral direction uniform.

Below, the components of the tubular shaped article according to the present invention will be explained.

1. Seam

The tubular shaped article according to the present invention has only one seam extending in the axial direction. Here, the fact that the tubular shaped article has only one seam extending in the axial direction means that one metal plate is shaped into a tubular shape. Therefore, a tubular shaped article obtained by shaping a metal plate in advance into a tubular shape to fabricate a plurality of tubular members and welding the tubular members not only has a plurality of seams in the longitudinal direction, but also has seams in the peripheral direction, so is not included in a tubular shaped article according to the present invention.

At the seam, the edges may be in close contact with each other or may be separated. That is, there may be clearance in the seam. Further, the seam may also be welded. If the edges of the seam are separated, the degree of separation may be made a distance (shortest) between the edges of 1 mm to 100% of the total length of the cross-sectional U-shape.

When viewing the tubular shaped article so that the seam is positioned right above, the seam and centerline are preferably straight since there is resistance to shaping defects, but these may also be slightly curved.

Further, the tubular shaped article need only be one formed by shaping a single metal plate into a tubular shape. For example, it may be comprised of a single tailored blank shaped into a tubular shape.

2. Bent Part

The bent part is a part with a bottom part positioned at the opposite side from the above seam in the peripheral direction and projecting to the inside in the axial direction. Here, the bottom part of the tubular shaped article means a part positioned at the opposite side from the seam at the cross-section including the seam and centerline. The tubular shaped article may have a single bent part or may have several.

The ratio H1/H2 of the plate thickness H1 at the seam of the bent part and the plate thickness H2 at the bottom part of the bent part satisfies the following equation (3):

$$H1/H2 \geq Ri/(Ri+D) \quad (3)$$

(where in the above equation (3), Ri is the radius of curvature at the bottom part side of the bent part, while D is the width of the bent part of a cross-section including the seam and centerline of the tubular shaped article)

The plate thickness H1 at the seam of the bent part and the plate thickness H2 at the bottom part of the bent part may be distributed in the longitudinal direction or peripheral direction, but preferably is uniform in the longitudinal direction or peripheral direction. Here, the plate thickness H1 at the seam of the bent part is made a plate thickness of the seam at the center of bending in the longitudinal direction of the tubular shaped article. Similarly, the plate thickness H2 at the bottom part of the bent part is made the plate thickness of the bottom part at the center of bending in the longitudinal direction of the tubular shaped article.

Further, in the cross-section including the seam and centerline of the tubular shaped article, the width D of the bent part (for example, see FIG. 11) is made the width at the center of bending. Similarly, the radius of curvature Ri at the bottom part side of the bent part (for example, see same figure) is made the radius of curvature of the intersection between the bottom part of the bent part and the plane including the seam and bending centerline.

Next, the rate of reduction of plate thickness

T of the seam of the bent part preferably satisfies the following equation (4):

$$T < D/2(Ri+D) \quad (4)$$

(where in the above equation (4), Ri is the radius of curvature at the bottom part side of the bent part, while D is the width of the bent part of the cross-section including the seam and centerline of the tubular shaped article)

Here, the rate of reduction of plate thickness T at the seams of the bent parts is found by the following equation (5):

$$T=(H0-H1)/H0\times 100[\%] \quad (5)$$

(where in the above equation (5), H0 is the plate thickness of the region becoming a bent part of the metal plate, while H1 is the plate thickness of the seam of the bent part)

In the tubular shaped article according to the present invention, as explained above, in the bent part, it is possible to make the distribution of plate thickness uniform and possible to suppress local decrease of plate thickness, so the rate of reduction of plate thickness T at the seam of the bent part satisfies the above equation (5).

For example, as shown in FIG. 11, when defining the width of the bent part 10*a* of the cross-section including the seam 4 and centerline S of the tubular shaped article 1*d* as D and defining the radius of curvature of the bottom part 5 side of bent part 10*a* as Ri, preferably the rate of reduction of the plate thickness at the seam 4 of the bent part 10*a* is less than D/2(Ri+D).

Similarly, for example, as shown in FIG. 12, when the widths of the bent parts 10*a* of the cross-section including the seam 4 and centerline S of the tubular shaped article 1*d* are made D1 and D2 and the radii of curvature of the bottom part 5 sides of the bent parts 10*a* are made Ri1, Ri2, the rates of reduction of plate thickness at the seams 4 of the bent parts 10*a* are preferably less than D1/2(Ri1+D1) and less than D2/2(Ri2+D2).

3. Straight Part and Taper Part

The tubular shaped article according to the present invention may have a straight part and a taper part. Further, the straight part and taper part may be single parts or several parts.

4. Shape of Tubular Shaped Article

The shape of the tubular shaped article, as explained above, may be any type described in FIG. 2C, FIGS. 4A and 4B, FIGS. 9C to 9E, and FIGS. 10A to 10F.

The method of producing a shaped article, tooling, and tubular shaped article according to the present invention shown above is not limited to the above-mentioned embodiment. These embodiments are illustrations. Any part having substantially the same configuration as the technical idea described in the claims of the present invention and exhibiting similar actions and effects is included in the technical scope of the present invention.

EXAMPLES

Below, examples will be used to verify the effects of the present invention.

Preparation of Tubular Shaped Article

Example 1

A bent round tube such as shown in FIG. 11 (tubular shaped article) was fabricated. The radius of curvature of the bent part of the tubular shaped article was 215 mm, the bending angle (meaning acute angle formed by extension of centerline S at one straight part 10*b* and the centerline S at the other straight part 10*b*, same below) was 40°, the outside diameter of the bent round tube was 65 mm, and the length of the straight part was 150 mm.

For the metal plate, a hot rolled steel sheet having a wide shape at the center of bending (center in longitudinal direction) compared with the two ends in the longitudinal direction such as shown in FIG. 3, having a tensile strength (TS)

of 440 MPa, and having a plate thickness of 2.6 mm was used. Further, tooling such as shown in FIG. 1 and FIG. 2 was used to successively perform U-forming, bending, and O-forming and obtain a tubular shaped article of Example 1.

Comparative Example 1

Except for performing the U-forming and bending simultaneously, the exact same procedure was followed as with the fabrication of the tubular shaped article of Example 1 to obtain the shaped article of Comparative Example 1. However, in the case of Comparative Example 1, as explained later, the operation up to the second step of the present invention was performed. The third step (closing of cross-section) was not performed.

Example 2

Except for using the tooling shown in FIGS. 5 and 6 instead of the tooling shown in FIG. 1, the same procedure was followed as in the fabrication of the tubular shaped article of Example 1 to obtain the tubular shaped article of Example 2.

Example 3

Except for making the radius of curvature of the bent part of the tubular shaped article 65 mm, the same procedure was followed as in the fabrication of the tubular shaped article of Example 2 to obtain the tubular shaped article of Example 3.

Comparative Example 2

Except for simultaneously performing the U-forming and bending, the same procedure was followed as in the fabrication of the tubular shaped article of Example 2 to obtain the shaped article of Comparative Example 2. However, in the case of Comparative Example 2, in the same way as the case of Comparative Example 1, as explained below, the procedure up to the second step of the present invention is performed and the third step (closing of cross-section) is not performed.

Example 4

A trumpet-shaped irregular diameter tube (tubular shaped article) such as shown in FIGS. 9C to 9E was fabricated. The radius of curvature of the bent part of the tubular shaped article was 80 mm, the bending angle was 10°, the outside diameter of the straight part was 40 mm, and the length of the straight part was 150 mm.

For the metal plate, a cold rolled metal plate having a tensile strength (TS) of 390 MPa and a plate thickness of 2.0 mm was used. Further, toolings such as shown in FIG. 7, FIG. 8, and FIG. 9 were used for successive U-forming, bending, and O-forming to obtain the tubular shaped article of Example 4.

Comparative Example 3

Except for simultaneously performing the U-forming and bending, the same procedure was followed as in the fabrication of the tubular shaped article of Example 4 to obtain the shaped article of Comparative Example 3. However, in the case of Comparative Example 3, in the same way as the case of Comparative Examples 1 and 2, as explained below, the procedure up to the second step of the present invention is performed and the third step (closing of cross-section) is not performed.

Evaluation

Evaluation Relating to Shaping Defects

The thus obtained tubular shaped articles (or shaped articles) of Examples 1 to 4 and Comparative Examples 1 to 3 were examined for occurrence of creasing at the vertical wall during shape (U-cross-section bent article), occurrence of fracture at the peripheral direction edge, and occurrence of wrinkling at the bottom part. Further, the above tubular shaped articles were investigated for welding defects at the time of the end of shaping. These results are shown together below. Note that, in examples where there was "occurrence of creasing of the vertical walls" (specifically, Comparative Examples 1 and 2) and in examples where there was "occurrence of fracture at peripheral direction edge" (specifically, Comparative Example 3), subsequent shaping was impossible, so the third step of the present invention is not performed. For this reason, in examples where there was "occurrence of creasing of vertical walls", it was not possible to judge if "fracture", "wrinkling", or "welding defects" occurred, while in the examples where there was "occurrence of fracture at peripheral direction edge", it was not possible to judge if "wrinkling" or "welding defects" occurred.

TABLE 1

| | Occurrence of creasing of vertical walls | Occurrence of fracture at peripheral direction end parts | Occurrence of wrinkling at bottom part | Welding defects (at time of O-forming) |
|---|---|---|---|---|
| Comparative Example 1 | Yes | — | — | — |
| Comparative Example 2 | Yes | — | — | — |
| Comparative Example 3 | No | Yes | — | — |
| Example 1 | No | No | No | No |
| Example 2 | No | No | No | No |
| Example 3 | No | No | No | No |
| Example 4 | No | No | No | No |

According to Table 1, it is learned that in Examples 1 to 4 included in the scope of the technical idea of the present invention, all gave good results of "No" for all items. As opposed to this, it is learned that in Comparative Examples 1 to 3 outside the scope of the technical idea of the present invention, all gave undesirable results in at least one item. These results are analyzed below for each test example.

Regarding Example 1, when fabricating the tubular shaped article, it was possible to perform bending without the bent part fracturing or wrinkling. Further, in O-forming, the seams were in good condition and laser arc hybrid welding could be used to join them. This is believed to be because the U-forming and the bending were performed in separate processes.

Regarding Comparative Example 1 and Comparative Example 2, when fabricating the shaped article, the vertical wall creased at the time of fabrication of the U-cross-section bent article, so shaping defects occurred at the stage of the U-cross-section bent article. This is believed to be because the U-forming and bending were performed at the same step.

Regarding Example 2, Example 3, and Example 4, when fabricating the tubular shaped article, bending was possible without the bent part fracturing or wrinkling. Further, in O-forming, the seam was in good condition and laser arc hybrid welding could be used to join it. Furthermore, the rate of reduction of the plate thickness of the seam after O-forming was generally zero. This is believed to be because the U-forming and bending were performed in separate processes and further because in the bending process, pads were used to apply external force toward the outside of the bottom part to at least part of the planned bending parts of the U-shaped article.

Regarding Comparative Example 3, when preparing a tubular shaped article, fracture occurred at the edges in the peripheral direction at the time of fabrication of the U-cross-section bent article, shaping defects occurred at the stage of the U-cross-section bent article, and O-forming was attempted, but joining was not possible even by laser arc hybrid welding. This is believed to be because the U-forming and bending were performed in the same process.

Evaluation Relating to Thickness Reduction Rate

Figure 13:
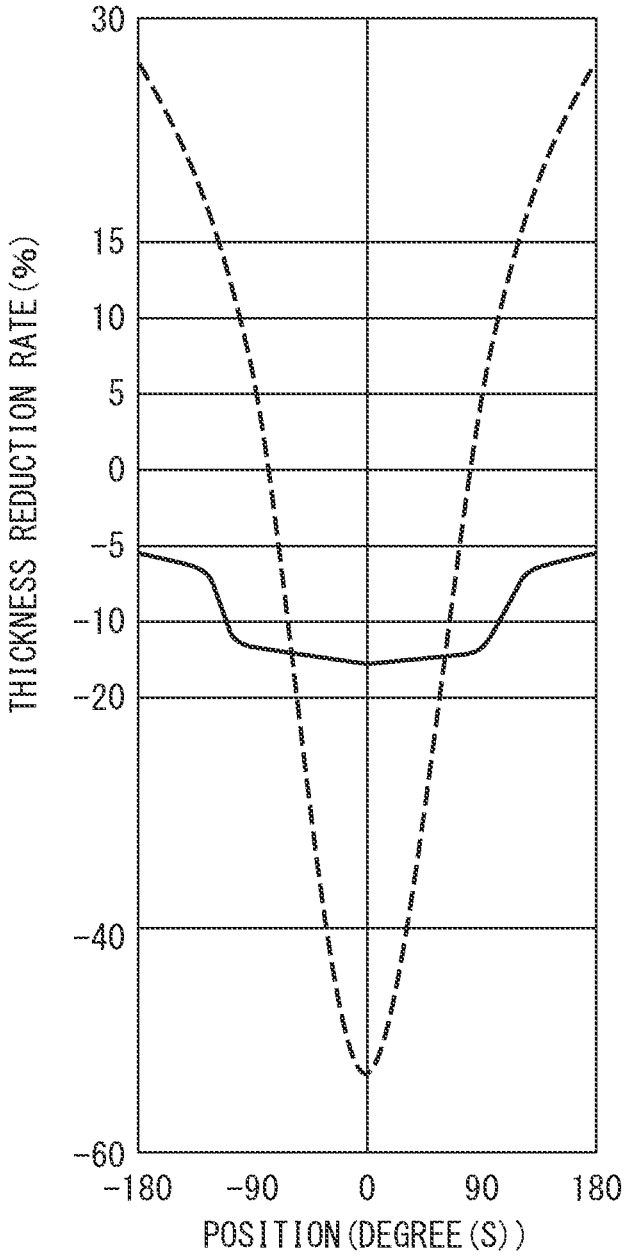
FIG. 13 is a graph showing a thickness reduction rate at a cross-section at the center of bending of Example 3.

Further, Example 3 was measured for the thickness reduction rate in the cross-section of the center of bending in the longitudinal direction of the tubular shaped article. Here, the "thickness reduction rate" means the rate of reduction of thickness at the different portions before and after the bending. In this evaluation, the thickness reduction rate when making the position of the bottom part 0 degree and the position of the seam at the opposite side in the peripheral direction 180 degrees was investigated. The results are shown in FIG. 13. Note that, in FIG. 13, the solid line shows the results of Example 3, while the broken line shows the calculated values when fabricating a tubular shaped article of the same dimensions as Example 3 by uniform bending using a steel tube as a material.

According to FIG. 13, in Example 3, the thickness reduction rate fell within about −5% to about −15%. It was learned that the thickness was not reduced at all. This is believed to be because at the time of the bending, pads were used to compress the edges along the longitudinal direction of the U-shaped article toward the outside of the bottom part of the U-shaped article in the planar direction.

Evaluation Relating to Ratio H1/H2

Further, whether Example 2, Example 3, etc. satisfy the following equation (6) was investigated. The results are shown in FIG. 14.

$$H1/H2 \geq Ri/(Ri+D) \quad (6)$$

(in the above equation (6), H1 is the plate thickness of the seam of the bent part, H2 is the plate thickness at the bottom part of the bent part, Ri is the radius of curvature of the bottom part side of the bent part, and D is the width of the bent part of the cross-section including the seam and the centerline of the tubular shaped article)

Figure 14:
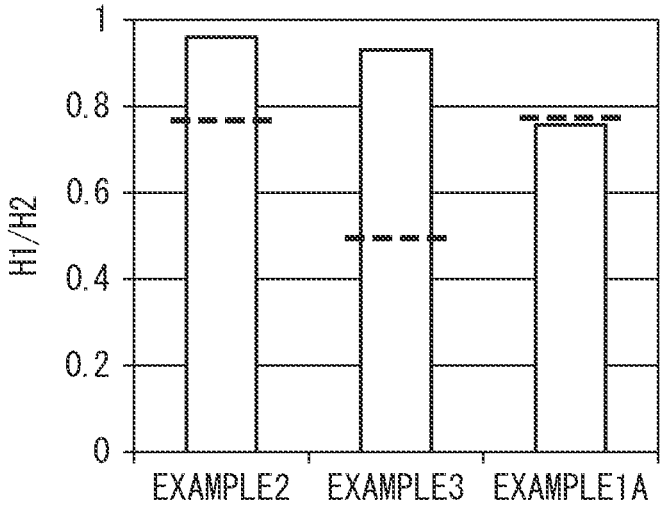
FIG. 14 is a graph showing the results of investigation of the ratio (H1/H2) of Examples 2 and 3.

Note that, in FIG. 14, Example 1A shows the measurement values in the case of fabrication of a tubular shaped article of the same dimensions as Example 1 by rotary draw bending using steel tube as a material. Further, the values shown by the bar graph correspond to the left side (H1/H2) of the above equation (6), while the broken line corresponds to the right side of the above equation (6).

According to FIG. 14, it will be understood that both Examples 2 and 3 satisfy the above equation (6). Therefore, it will be understood that in Examples 2 and 3, it is possible to make the distribution of plate thickness at the bent part uniform.

REFERENCE SIGNS LIST

1*a* . . . metal plate
1*b* . . . U-shaped article
1*c* . . . U-cross-section bent article
1*d* . . . tubular shaped article
2, 3, 5 . . . bottom part
4 . . . seam
6 . . . edges along the longitudinal direction of the U-shaped article
7 . . . planned bending part (region to be bent part)
8 . . . edges along longitudinal direction of U-cross-section bent article
10*a* . . . bent part
10*b* . . . straight part
10*c* . . . taper part
11, 21, 31 . . . die
12, 22, 32 . . . punch
11*a*, 21*a*, 31*a* . . . bottom part of recess of die
12*a*, 22*a*, 32*a* . . . bottom part of punch
23 . . . pad
x . . . longitudinal direction

The invention claimed is:

1. A method of producing a shaped article comprising:

a first step of press-forming a metal plate using a first tooling having a die with a widthwise U- shaped concave pressing surface extending straight in a longitudinal direction and a punch with a widthwise U-shaped convex pressing surface extending straight in a longitudinal direction to obtain a U-shaped article having an edge part and a bottom part straight extending in a longitudinal direction and a second step of press-forming said widthwise U-shaped article using a second tooling comprising a die with a pressing surface having a U-shaped widthwise concave cross-section and a U-shaped longitudinal cross-section formed curved projecting-toward the outside of the die, a punch with a pressing surface having a U-shaped widthwise convex cross-section and a U-shaped longitudinal cross-section formed curved recessing toward the inside of the punch, and pads covering at least parts of longitudinal side surfaces of the punch and arranged adjacent the pressing surface of the punch, wherein in the second tooling, while the widthwise U-shaped article is set between the pressing surfaces of the die and the punch and the punch is moved closer to fit the die along the longitudinal directions of the die and the punch, the pads and the punch integrally or individually move in a same direction of each other, and in the second step, an external force directed toward the bottom of the widthwise U-shaped article is applied along longitudinal edges of vertical walls of the widthwise U-shaped article by using the pads at the same time as the bending.

2. The method of producing a shaped article according to claim 1 further comprising a third step of shaping the widthwise U-cross-section bent article into a widthwise closed cross-section to obtain a tubular shaped article.

3. A system comprising a die with a pressing surface having a U-shaped widthwise concave cross-section and a U-shaped longitudinal cross-section formed curved projecting toward the outside of the die, a punch with a pressing surface having a U-shaped widthwise convex cross-section and a U-shaped longitudinal cross-section formed curved recessing toward the inside of the punch, and pads covering at least parts of the longitudinal side surfaces of the punch and arranged adjacent the pressing surface of the punch, wherein the pads are formed integrally with the punch or the pads are attached through springs to the punch or a press system controlling relative positions of the die and the punch so as to move up and down relative to the punch.

* * * * *